US005958002A

United States Patent [19]

Zhou et al.

[11] Patent Number: 5,958,002

[45] Date of Patent: Sep. 28, 1999

[54] VECTOR ABSOLUTE—VALUE CALCULATION CIRCUIT

[75] Inventors: Changming Zhou; Guoliang Shou; Kunihiko Suzuki; Kazunori Motohashi; Makoto Yamamoto; Sunao Takatori, all of Tokyo, Japan

[73] Assignee: Yozan, Inc., Tokyo, Japan

[21] Appl. No.: 08/905,784

[22] Filed: Aug. 12, 1997

[30] Foreign Application Priority Data

Aug. 13, 1996 [JP] Japan ..... 8-229402

[51] Int. Cl.[6] ..... G06G 7/00; G06G 7/16

[52] U.S. Cl. ..... 708/801; 708/835

[58] Field of Search ..... 364/807, 841, 364/607, 715.012; 704/232

[56] References Cited

U.S. PATENT DOCUMENTS 4,032,768 6/1977 Rieger .
5,751,624 5/1998 Zhou et al. ..... 364/841

FOREIGN PATENT DOCUMENTS 584827 3/1994 European Pat. Off. .
764915 3/1997 European Pat. Off. .
239024 5/1997 France .

OTHER PUBLICATIONS

Sánchez–Sinencio et al, "Switched Capacitor Filters" The Circuits and Filters Handbook, CRC Press, Inc., 1995, pp. 2491–2520.

Allen et al, "CMOS Analog Circuit Design", Holberg, Harcourt Brace Jovanovich College Publishers, 1987, p. 558.

*Primary Examiner*—Tan V. Mai
*Attorney, Agent, or Firm*—Pillsbury Madison & Sutro LLP

[57] ABSTRACT

A highly accurate vector absolute-value calculation circuit uses analog processing and minimal hardware. Signal voltages corresponding to an I component (real number part) and a Q component (imaginary number part) are input to a first absolute-value calculation circuit 13 and a second absolute-value calculation circuit 14 through terminals 11 and 12, respectively, and they are each converted into absolute-value signals. The component I absolute-value and component Q absolute-value are compared in a comparison circuit 20. According to the result, the larger absolute-value signals are output to an input capacitor 23 of a neural computation circuit, and the smaller absolute-value signals are output to an input capacitor 24 by controlling multiplexers 21 and 22. The capacity ratio of a feedback capacitor 26 of a neural computation circuit and input capacitors 23 and 24 is 11:10:5. The complex number absolute-value calculated by the following formula is output from an output terminal 27.

$$Mag = \frac{12}{11}\mathrm{Max}\{\mathrm{Abs}(a), \mathrm{Abs}(Q)\} + \frac{5}{11}\mathrm{Min}\{\mathrm{Abs}(I), \mathrm{Abs}(Q)\}$$

15 Claims, 11 Drawing Sheets

VECTOR ABSOLUTE— VALUE CALCULATION CIRCUIT

FIELD OF THE INVENTION

The present invention relates to an analog vector absolute-value calculation circuit for calculating a composite vector including two quadrature signals such as the real and imaginary parts of a complex number.

BACKGROUND OF THE INVENTION

The calculation of a composite vector with two quadrature signals is used in various fields. For example, in a spread-spectrum communication system receiver using Quadrature Phase Shift Keying (QPSK), the absolute-value of a complex number comprising I channel and Q channel signals is calculated as shown in formula (1) so as to judge whether the despreaded signal is at the correlation peak.

$$Mag = \sqrt{I^2 + Q^2} \tag{1}$$

In formula (1), Mag is the absolute-value of a complex number.

Usually, such calculations are performed by a DSP (Digital Signal processor) using approximation formulas. For example, Stanford Telecom in the United Slates developed a highly-rated digital LSI for calculating approximate values in formula (2):

$$Mag=Max\{Abs(I),Abs(Q)\}+\tfrac{1}{2}Min\{Abs(I), Abs(Q)\} \tag{2}$$

In formula (2), Max { } id the maximal value, Min { } is the minimal value, and Abs( ) is the absolute-value.

The inventors have proposed various analog operation circuits and filter circuits that feature low electric power consumption, high speed and high accuracy.

FIG. 15(*a*) shows the fundamental structure of an analog operation circuit (hereinafter, neural computation circuit). In FIG. 15(*a*), V1 and V2 are input terminals, Vo is an output terminal, and Amp is an inverting amplifier. In Amp, utilizing the part changing the outputs of CMOS inverters from a high level to a low level or from a low level to a high level, inverters form an amplifier comprising CMOS inverters serially connected in an odd number of stages, three such inverters 111, 112 and 113, being shown.

Input capacitor C1 is provided between and serially to V1 and point B at the input of Amp, and input capacitor C2 is provided between and serially to V2 and B. Feedback capacitor Cf is connected between Vo and B.

Registers R1 and R2 are provided to control the gain of the amplifiers, and capacitor Cg is provided to adjust the phase. Both of them prevent oscillation within Amp.

In a circuit with such a structure, as the voltage amplifying ratio of Amp is very large, the voltage at B is approximately constant and assumed to be Vb. Point B is connected to C1, C2, Cf and the gate of the transistor which structures 111, and B is also floating from every source voltage.

When the electric charge stored in each capacitor in the initial state is 0, the total charge stored in each capacitor referencing B is 0, even after V1 and V2 are input. From this, formula (3) is true:

$$C1(V^1-Vb)+C2(V2-Vb)-Cf(Vo-Vb)=0 \tag{3}$$

The dynamic range is made maximal by setting the voltage Vb at B to be half of the source voltage. Therefore, Vb is set to be Vdd/2 when the source voltage is supplied by +Vdd and ground (0V), and Vb is set to be 0 when the source voltage is plus and minus. Here, it is assumed that the source voltage is +Vdd and ground, and Vb=Vdd/2. Accordingly, formula (4) is derived from formula (3):

$$Vo = -\left(\frac{C1}{Cf}V1 + \frac{C2}{Cf}V2\right) + \frac{C1 + C2 + Cf}{2Cf}Vdd \tag{4}$$

Output Voltage Vo is output from the neural computation circuit. Vo has an offset voltage of ((C1+C2+Cf)/2Cf)Vdd, and its voltage is the sum of V1 and V2 after multiplying C1/Cf and C2/Cf, respectively, with inverted polarity. The offset voltage can be easily deleted by providing voltage to cancel it to the output of Amp through a capacitor. A weighted addition circuit for adding a plurality of weighted input signals can thus be formed.

Also, a subtraction circuit can be structured by connecting two addition circuits in series, then providing positive inputs to the former and negative inputs to the latter.

Further, an addition circuit for the control signals and input analog signals can be structured by changing the size of input capacitors C1 and C2 according to the control signals.

Although there are two input terminals (V1 and V2) in this embodiment, any number of input terminals can be adopted.

As stated above, various computation circuits can be constructed from neural computation circuits, which require very low electric power consumption and operate at high speeds because they are driven only by the electric voltage. The capacitor size is determined by the conductor area on a semiconductor substrate: this area can be precisely controlled, and very accurate computation circuits realized.

To simplify, FIG. 15(*b*) is used instead of FIG. 15(*a*).

Circuits with such analog architecture have problems contrary to digital LSIs like the above DSP, because operations are performed by analog voltage.

Therefore, a complex absolute-number calculation circuit is proposed for analogously calculating vector absolute-value by formula (2) or the improved formula of Japanese Patent Application No. 7-274839.

FIG. 16 shows an exemplary block diagram of the proposed complex absolute-value calculation circuit.

In FIG. 16, 121 shows an input terminal for receiving the signal of component I corresponding to the real part of a complex number, 122 shows an input terminal for receiving the signal of component Q corresponding to its imaginary part, 123 shows the first absolute-value calculation circuit for outputting the absolute-value Abs (I) of component I input from terminal 121, and 124 shows the second absolute-value calculation circuit for outputting the absolute-value Abs (Q) of component Q input from input terminal 122. Number 125 shows a subtraction circuit for outputting the difference between the output of 123 and that of 124 (Abs(1)−Abs(Q)), 126 shows the third absolute-value calculation circuit for outputting, the absolute-value of the output of 125 (Abs(Abs(1)−Abs(Q)), and 127 shows an addition circuit for adding outputs from 124 and 126 with weighting. As shown, the outputs of 123, 124 and 126 are weighted with values b, c and a, respectively.

Neural computation circuits are used in absolute-value calculation circuits 123, 124 and 126, subtracting circuit 125 and addition circuit 127.

Circuits 123, 124 and 126 have the same structure which FIG. 17 shows. In FIG. 17, 131 shows an input terminal for receiving analog signal voltage Vin, and 137 shows an output terminal for outputting signals corresponding to the absolute-value of Vin ([Vin]).

Number 132 shows an input capacitor C1, 133 shows a feedback capacitor Cf, and 134 shows the inverting amplifier above. These include the neural computation circuit. As the ratio of 132 and 133 is 1 (C1=Cf), the output voltage of inverting amplifier 134 is the signal voltage Vin (Vdd−Vin) input from 131.

Number 135 shows an inverter circuit, structured like a CMOS. Threshold voltage Vth is half the source voltage Vdd, that is, Vth=Vdd/2. Therefore, when input signal voltage Vin is equal to or greater than Vdd/2, the output level is low (0V), and when input signal voltage Vin is lower than threshold voltage Vth, the output level is high (Vdd). This means inverter 135 functions as a comparator for comparing input signal voltage Vin with voltage Vdd/2.

Number 136 shows a multiplexer including a pair of CMOS transmission gates. When the output of 135 is a low level, the output from 134 (Vdd−Vin) is selected and output to 137, and when the output of 135 is a high level, input signal Vin is output from output terminal 137 as it is.

This absolute-value calculation circuit outputs Vdd−Vin when Vin≧Vdd/2, and it outputs Vin when Vin<Vdd/2. Referencing Vdd/2, input signal Vin is output, which has a higher level than the reference level, and is inverted in the direction lower than the reference voltage; that is, the output signal is the inverted absolute-value having the reference level Vdd/2 of the input signal.

Assuming weighted coefficients a=5/22 and b=c=15/22 in addition circuit 127, the complex number absolute-value Mag calculated by approximation formula (5) is output from output terminal 128:

$$Mag = \frac{15}{22}(\mathrm{Abs}(I) + \mathrm{Abs}(Q)) + \frac{5}{22}\mathrm{Abs}(\mathrm{Abs}(I) - \mathrm{Abs}(Q)) \tag{5}$$

Formula (5) calculates approximate values more precisely than formula (2). When a, b and c are changed into other values and used in the approximation formulas, any vector absolute-value can be calculated.

SUMMARY OF THE INVENTION

The complex number absolute-value calculation circuit above calculates complex number absolute-values rapidly and accurately with low electric power consumption using analog computation circuits (neural computation circuits). However, it needs many such circuits and is complex in structure. For example, the circuit in FIG. 16 needs six neural computation circuits: one for each absolute-value calculation circuit, two for the subtraction circuit, and one for the addition circuit.

The problem with such analog computation circuits is that the residual charge generated in each capacitor causes an offset voltage which lowers output accuracy. The solution is to cancel the residual charge through refreshing at predetermined periods. However, to refresh without lowering the processing speed, each device has to be provided in duplicate and alternately refreshed, requiring a doubling of hardware.

An object of the present invention is to provide a vector absolute-value calculation circuit with simpler structure capable of calculating the absolute-value of a composite vector comprising two quadrature signals such as a real and an imaginary part of a complex number.

A further object is to provide an analog vector absolute-value calculation circuit capable of refreshing with a minimal increase in hardware.

To achieve the above objects, a vector absolute-value calculation circuit is provided. A first absolute-value calculation circuit, to which a first input signal is input corresponding to a first component of a two-dimensional vector, outputs a first absolute-value calculated signal with the same amplitude as that of the first input signal, and with a single polarity. A second absolute-value calculation circuit, to which a second input signal is input corresponding to a second component of a two-dimensional vector, outputs a second absolute-value calculated signal with the same amplitude as that of the second input signal, and a single polarity. An operating mechanism multiplies the first coefficient with a larger signal among the first and second absolute-value signals, multiplies the second coefficient with a smaller signal among them, and outputs the sum of both multiplication results.

In another vector absolute-value calculation circuit according to the present invention, a first input terminal receives a first input signal corresponding to the first component of a two-dimensional vector, and a second input terminal receives a second input signal corresponding to the second component of a two-dimensional vector. A first absolute-value calculation circuit connected to the first input terminal outputs a first absolute-value signal with the same amplitude as that of the first input signal and a single polarity. A second absolute-value calculation circuit connected to the second input terminal outputs a second absolute-value signal with the same amplitude as that of the second input signal and a single polarity. A comparison circuit compares the first and second absolute-value signals. A first selector selects and outputs the first absolute-value signal when it is equal to or larger than the second absolute-value signal, and selects and outputs the second absolute-value signal when the first absolute-value signal is smaller than the second one after the comparison in the comparison circuit. A second selector selects and outputs the second absolute-value signal when it is equal to or larger than the second absolute-value signal, and selects and outputs the first absolute-value signal when the first absolute-value signal is smaller than the second one after the comparison in the comparison circuit. A weighted addition circuit multiplies the first coefficient with an input signal from the first selector, multiplies the second coefficient to an input signal from the second selector, and outputs the sum of both multiplication results.

In another vector absolute-value calculation circuit according to the present invention, a first input terminal receives a first input signal corresponding to a first component of a two-dimensional vector, and a second input terminal receives a second input signal corresponding to a second component of a two-dimensional vector. A first absolute-value calculation circuit connected to the first input terminal outputs the first absolute-value signal with the same amplitude as that of the first input signal and with a single polarity. A second absolute-value calculation circuit connected to the second input terminal outputs a second absolute-value signal with the same amplitude as that of the second input signal and with a single polarity. A first weighted addition circuit multiplies the first coefficient with the first absolute-value signal, multiplies the second coefficient with the second absolute-value signal, and outputs the sum of both multiplication results. A second weighted addition circuit multiplies the second coefficient with the first absolute-value signal, multiplies the first coefficient with the second absolute-value signal, and outputs the sum of both multiplication results. A comparison circuit compares the first and second absolute-value signals. A selector selects and outputs the output of the first weighted addition circuit when it is equal to or larger than the second absolute-value signal, and selects and outputs the output of the second absolute-value signal when the first absolute-value signal is smaller than the second one after the comparison in the comparison circuit.

The first coefficient is 10/11 and the second coefficient is 5/11.

The weighted addition circuit may comprise: a first input terminal; a second input terminal; a first input capacitor with one of its terminals connected to the first input terminal; a second input capacitor with one of its terminals connected to the second input terminal; and an inverting amp lifer. The input of the inverting amplifier is connected to the other terminals of the first and second input capacitors, and a feedback capacitor is connected between the input and output of the inverting amplifier.

Both the first and second weighted addition circuits may comprise: a first multiplexer, a second multiplexer, first and second input capacitors, an inverting amplifier, and a switching circuit. The first multiplexer receives and outputs one of the first absolute-value signal and the reference potential. The second multiplexer receives and outputs one of the second absolute-value signal and the reference potential. The first input capacitor has one terminal connected to an output of the first multiplexer. The second input capacitor has one terminal connected to an output of the second multiplexer. An inverting amplifier has an input connected to the other terminals of the first and second input capacitors. A feedback capacitor is connected between the input and output of the inverting amplifier. A switching circuit is connected in parallel to the feedback capacitor. A reference potential is input to a weighted addition circuit not selected by the selector so as to control closure of the switching circuit.

The first absolute-value calculation circuit may comprise: an input terminal for receiving the first input signal; a polarity-inverting circuit for outputting signals with inverted polarity of the first input signal; and a selecting circuit. The selecting circuit selects and outputs a signal out of the first input signal and the output signal of the polarity-inverting circuit, according to the polarity of the first input signal.

The second absolute-value calculation circuit may comprise: an input terminal for receiving the second input signal; first and second output terminals; a polarity-inverting circuit for outputting signals with inverted polarity of the second input signal; and a selecting circuit. The selecting circuit output signals of the polarity-inverting circuit and the second input signals to the first and second output terminals, respectively, when the second input signal is the first polarity, and outputs the second input signals and the output signals of the polarity-inverting circuit to the first and second output terminals, respectively, when the second input signal is the second polarity.

The polarity-inverting circuit comprises an input capacitor having one terminal connected to the input terminal and another terminal connected to an input terminal of an inverting amplifier having a feedback capacitor between its input and output. The capacitance ratio of the input capacitor and feedback capacitor is 1. A multiplexer circuit is also provided having one input connected to the input terminal, and the another input connected to a reference potential, for selecting and outputting either a signal input from the input terminal according to an input control signal or the reference potential. An input capacitor has one terminal connected to an output of the multiplexer circuit and another connected to an input terminal of an inverting amplifier. An inverting amplifier is connected to a feedback capacitor having the same capacity as that of the input capacitor between its input and output. A switching circuit is connected in parallel to the feedback capacitor, controlled to open and close by the control signal, wherein the control signal is an output signal of the first absolute-value calculation circuit.

The second absolute-value calculation circuit comprises the first and second polarity-inverting circuits which comprise several elements including an input terminal which receives the second input signal and first and second output terminals. A multiplexer circuit, one of whose inputs is connected to the input terminal and the other input provided the reference potential, selects for output either a signal input from the input terminal according to an input control signal or the reference potential. An input capacitor has one terminal connected to an output of the multiplexer circuit and another connected to an input terminal of an inverting amplifier. An inverting amplifier has a feedback capacitor having the same capacity as that of the input capacitor connected between its input and output. A switching circuit is connected in parallel to the feedback capacitor, controlled to open and close by the control signal. A selector outputs output signals of the first polarity-inverting circuit and the second input signal to the first output terminal and the second input terminal, respectively, when the second input signal is the first polarity, and outputs the second input signal and outputs of the second polarity-inverting circuit to the first output terminal and the second output terminal, respectively, when the second input signal is the second polarity.

The inverting amplifier is comprised of inverting circuits serially connected in an odd number of stages, and the first coefficient is defined by the capacitance ratio of the feedback capacitor and the first input capacitor, and the second coefficient is defined by the capacitance ratio of the feedback capacitor and the second input capacitor.

PREFERRED EMBODIMENT OF THE PRESENT INVENTION

Figure 1:
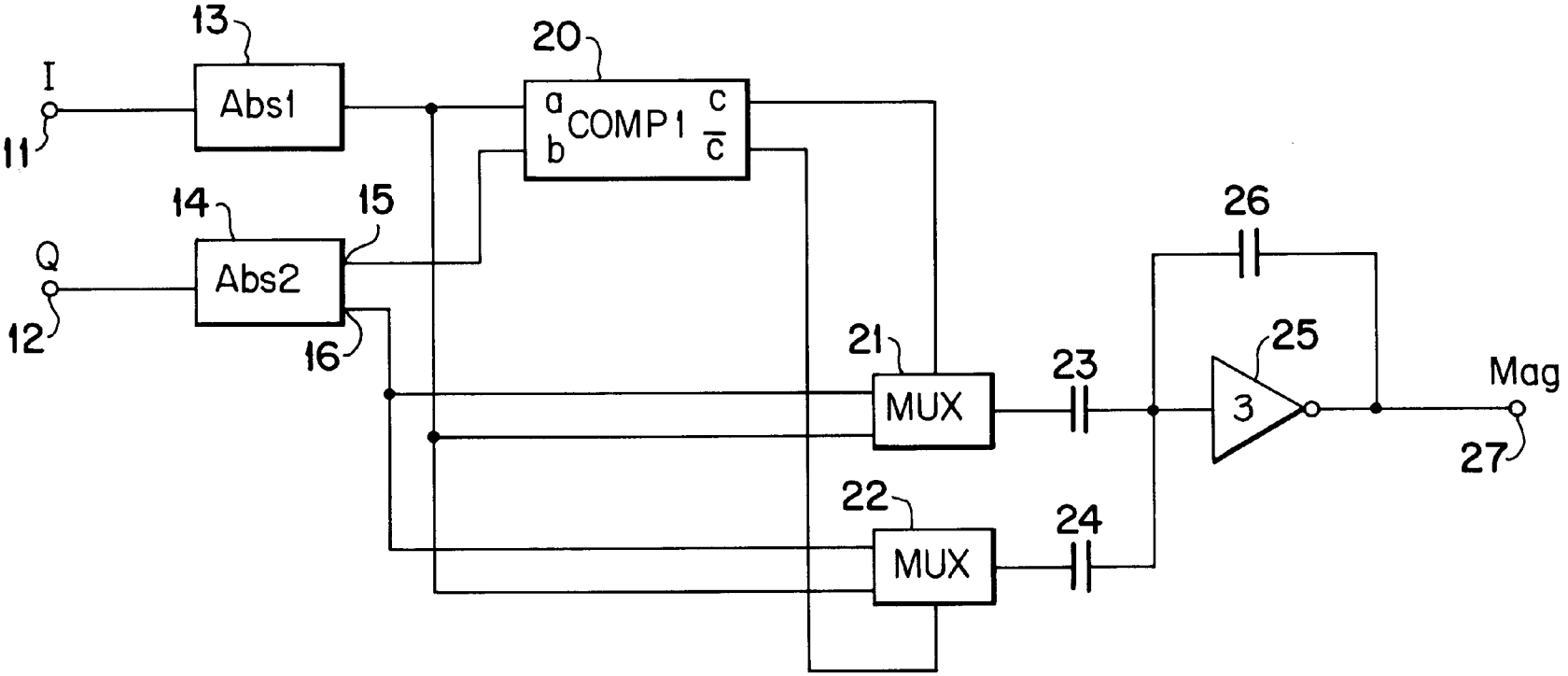
FIG. 1 shows a first embodiment of the vector absolute-value calculation circuit according to the present invention.

FIG. 1 shows a block diagram of the first embodiment of a vector absolute-value calculation circuit according to the present invention. Although the vector absolute-value calculation circuit of the present invention is adaptable to any configuration where two quadrature signals are input, the format here uses components I and Q for input signals modulated by QPSK, similar to the conventional technology above.

In FIG. 1, 11 is an input terminal for receiving the analog signal of component 1, and 12 is an input terminal for receiving the analog signal of component Q. These input signals have a reference potential of half of the source voltage Vdd (Vdd/2), and change in both upper and lower directions centering on the voltage Vdd/2. That is, input signal voltages V1=I+Vdd/2 of component I and VQ=Q+Vdd/2 of component Q are input to the circuit from their corresponding input terminals 11 and 12.

Number 13 shows the first absolute-value calculation circuit (Abs1) for outputting absolute-value Abs(l) of the signal of component I input from input terminal 11, and 14 shows the second absolute-value calculation circuit (Abs2) for outputting absolute-value Abs(Q) of the signal of component Q input from input terminal 12 or the inverted signal of Abs(Q) from the first output terminal 15 or from the second output terminal 16, respectively. Details of Abs1 and Abs2 are provided below.

Number 20 shows the first comparator which compares the magnitude of input signals from input terminals a or b. It then outputs a high level signal at output terminal c and a low level signal at inverted output terminal (inverted c) when the signal voltage from a is equal to or higher than that from b with inverted polarity, and outputs a low level signal at c and a high level signal at inverted output terminal (inverted c) when the input voltage from input terminal a is lower than the input voltage from b with inverted polarity. A detailed description will be provided later.

Number 21 shows the first multiplexer to which the output of the first absolute-value calculation circuit 13 and the second output 16 of the second absolute-value calculation circuit 14 are input. It selects the output of the first absolute-value calculation circuit 13 when the control signal output c from comparator 20 is a high level, and selects 16 when it is a low level. Number 22 shows the second multiplexer circuit to which the output from 13 and the output 16 are input. It selects the output from 13 when the inverted output from 20 is a high level, and selects 16 when it is a low level.

Number 25 shows the inverting amplifier used in the above neural calculation circuit. The output of 21 is input through the first input capacitor 23, and the output of 22 is input through the second input capacitor 24. Number 26 shows a feedback capacitor connected to 25, and 27 shows an output terminal for outputting absolute-value signal Mag.

Figure 2:
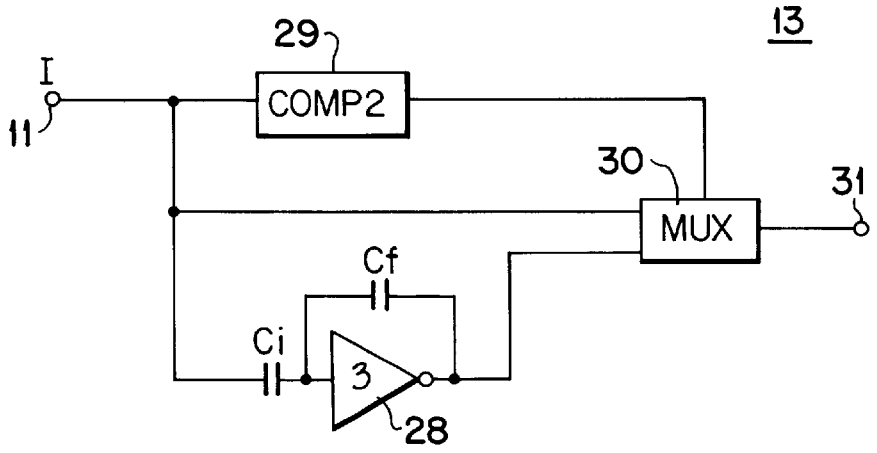
FIG. 2 shows the structure of the first absolute-value calculation circuit in the first embodiment of the vector absolute-value calculation circuit.

FIG. 2 shows an exemplary structure of 13 in FIG. 1. In FIG. 2, 28 shows the inverting amplifier used in the neural computation circuit above, connected to component I input terminal 11 through input capacitor Ci. The ratio of the capacities of Ci and feedback capacitor Cf is 1. Number 29 shows the second comparator for comparing component I input signal voltage from 11 to the reference potential (Vdd/2), and 30 shows a multiplexer circuit to which the output from 29 is input as a control signal. The second comparator 29 compares input signals and the reference potential (Vdd/2). A low level signal is output from its output terminal when the input signal is equal to or higher than the reference potential, and a high level signal is output when the input signal is lower than the reference potential. That is, the second comparator outputs a low level signal when the input signal is positive, and outputs a high level signal when the input signal is negative. It can judge the polarity of the input signals.

To 30, component I input terminal 11 is connected as the first input, the output of 28 is input as the second input, and the output signal of 29 is input as a control signal. Multiplexer circuit 30 selects input signal 1 from component I input terminal 11 when the output of 29 is high level, and it selects the output of 28 when the output of 29 is low level, and the selected signal is output from output terminal 31.

Figure 3:
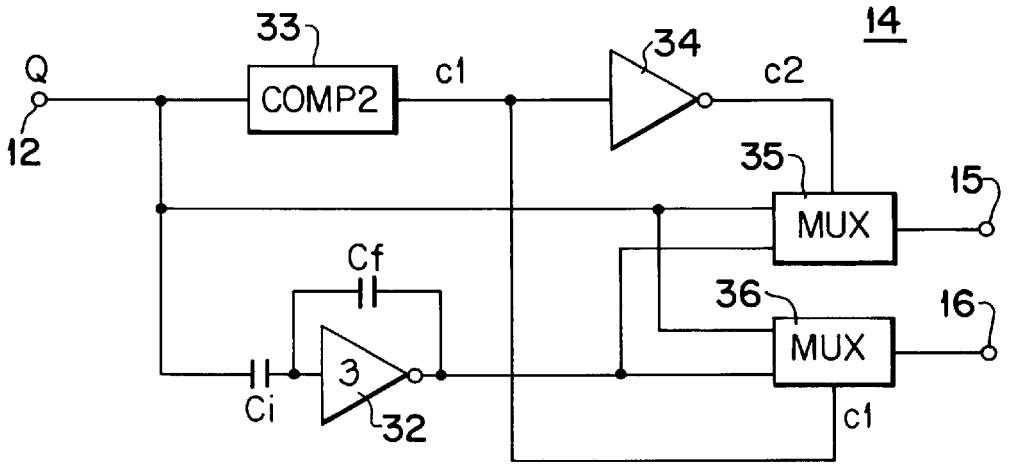
FIG. 3 shows the structure of the second absolute-value calculation circuit in the first embodiment of the vector absolute-value calculation circuit.

FIG. 3 shows an exemplary structure of the second absolute-value calculation circuit 14 in FIG. 1. In FIG. 3, 32 shows the inverting amplifier used in the neural computation circuit above, and it is connected to component Q input terminal 12 through input capacitor Ci. The ratio of the capacities of Ci and feedback capacitor Cf is 1. Number 33 shows the second comparator for comparing component Q input signal voltage from 12 to the reference potential (Vdd/2), 34 shows an inverting circuit, 35 shows the first multiplexer, and 36 shows the second multiplexer. The output of 33 is input to 36 as control signal c1 at the same time it is input to 34. The output of 34 is then input to 35 as control signal c2.

Input terminal 12 of component Q is connected to the first inputs of both 35 and 36, and the output of 32 is connected to their second inputs. The first multiplexer circuit 35 selects component Q signal input from 12 and outputs it at the first output terminal 15 when c2 from 34 is high level, conversely, 35 selects the output of 32 and outputs it at 15 when c2 is low level. The second multiplexer circuit 36 selects component Q signal input from 12 and outputs it at the second output terminal 16 when c1 from 33 is a high level; on the other hand, 36 selects the output of 32 and outputs it at 16 when c1 is a low level.

Figure 4:
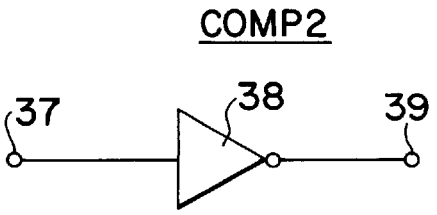
FIG. 4 shows an exemplary structure of the second comparator circuit.

FIG. 4 shows an exemplary structure of the second comparators 29 in FIG. 2 and 33 in FIG. 3. As shown, 29 and 33 can be structured using inverter 38 with a CMOS or equivalent configuration and threshold voltage Vth=Vdd/2 (the reference potential). When Vin≧Vdd/2 (Vin is the input voltage from input terminal 37), the output of 38 is low level, and a low level signal is output from output terminal 39. When Vin<Vdd/2, the output of 38 is a high level, and a high level signal is output from 39. A comparator for comparing Vin and the reference potential (Vdd/2) can be structured in this way.

Figure 5:
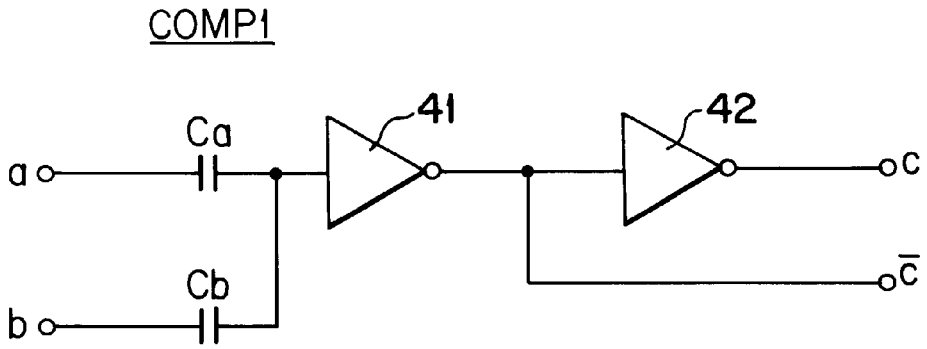
FIG. 5 shows an exemplary structure of the first comparator circuit.

FIG. 5 shows an exemplary structure of the first comparator 20 (COMP 1) in FIG. 1. In FIG. 5, 41 and 42 are serially-connected inverting circuits with, for example, CMOS configurations. The threshold voltage Vth of 41 and 42 is Vdd/2 (=reference potential Vref). The input of the first inverting circuit 41 is connected to the combining point of the first capacitor Ca and the second capacitor Cb, and one of their terminals is connected to input a and input b, respectively. Capacitors Ca and Cb have the same capacity, and (a+b)/2 (the average of the voltages of a and b) appears at the combining point. The output of 41 is connected to the inverted output (inverted c) and simultaneously connected to the input of 42, whose output is connected to output terminal c.

In such a circuit, the voltage at the combining point of Ca and Cb –(a+b)/2– is input to 41. Therefore, when (a+b)/2 is equal to or larger than Vth(=Vdd/2), the output of 41 is a low level and that of 42 is a high level. In this case, output c is high, and the inverted output of c is low. When (a+b)/2<Vth, the output of 41 is high and that of 42 is low; consequently, c is low and inverted c is high.

Figure 6:
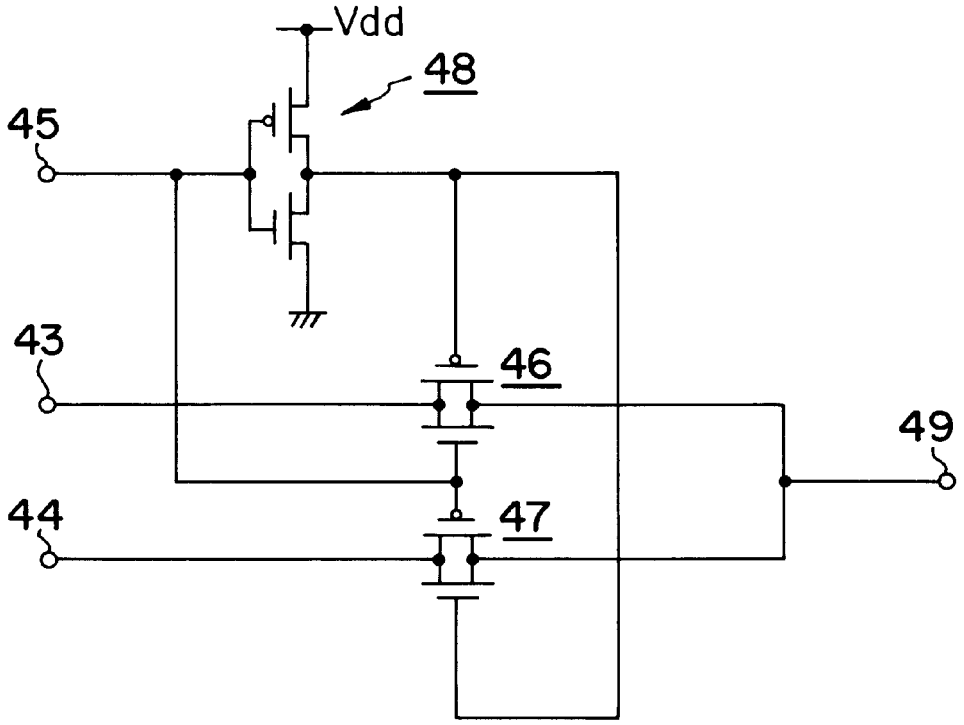
FIG. 6 shows an exemplary structure of a multiplexer circuit.

FIG. 6 shows an exemplary structure of MUX in the circuits above. In FIG. 6, 43 is the first input terminal, 44 is the second input terminal, 45 is the control signal input terminal, 49 is the output terminal, 46 and 47 are CMOS transmission gates, and 48 is a CMOS inverter.

In such a multiplexer circuit, when the control signal that is input to control signal input terminal 45 is higher (high level) than of the threshold voltage Vth (=Vdd/2) of CMOS inverter 48, transmission gate 46 is on and 47 is off, resulting in the signal from 43 being output at 49. Conversely, when the input voltage to terminal 45 is lower (low level) than Vth, 46 is off and 47 is on, resulting in the signal from 44 is output at 49.

The function of a vector absolute-value calculation circuit with this structure is described.

As mentioned, component I input signal voltage V1=I Vdd/2 from component I input terminal 11 is input to the first absolute-value calculation circuit 13. From inverting amplifier 28 in 13 (shown in FIG. 2), the voltage Vdd−VI= Vdd/2−I, which is the inversion of component I input signal voltage V1, is output. When component I input signal VI (=I+Vdd/2) is larger than the reference potential (Vdd/2), that is, when I≧0, a low level control signal is input to multiplexer circuit 30 from the second comparator 29, and 30 selects and outputs the output signal Vdd/2−I from 28 at the output terminal 31, as described above. And when VI is smaller than Vdd/2, that is, when I<O, a high level signal is output from 29, and input signal V1=Vdd/2+1 from 11 is output from 30 and sent to 31 as it is.

From the first absolute-value calculation circuit 13, the inverted signal of component I signal absolute-value I|, that is, the signal equivalent to Vdd/2−|I, is output.

Component Q input signal voltage (VQ=Q+Vdd/2) is input from component Q input terminal 12, VQ being input to the second absolute-value calculation circuit 14. Inverted output Vdd−VQ=Vdd/2−Q is then output from inverting amplifier 32 in the second absolute-value calculation circuit 14 (FIG. 3). When component Q signal input VQ (=Q+Vdd/2) is larger than the reference potential (Vdd/2), that is, when Q≧0, the output c1 of the second comparator 33 is low and the output c2 of inverter circuit 34 is high. First multiplexer circuit 35 for receiving high level control signal c2 selects VQ=Q+Vdd/2 input from 12 so as to output it at the first output terminal 15. Second multiplexer circuit 36 for receiving low level control signal c1 selects Vdd/2−Q as the output from 32 so as to output it at the second output terminal 16.

When component Q input signal VQ has a voltage lower than the reference potential (Vdd/2), that is, Q<0, c1 is high and c2 is low. Conversely, 35 selects Vdd/2−Q which is the output of 32 so as to output it at 15, and 36 selects component Q input signal VQ=Q+Vdd/2 so as to output it at 16.

The absolute-value of component Q input signal |Q|+ Vdd/2 is output from 15, and its inverted value Vdd/2−|Q| is output from 16.

In FIG. 1, the absolute-value signal Vdd/2−|I| of the input signal of component I from 13 and the absolute-value signal |Q|+Vdd/2 from 15 are transmitted to inputs a and b of 20, respectively. In 20, the mean voltage of inputs a and b ((a+b)/2) and the reference potential (Vdd/2) are compared. Here, as a−Vdd/2−|I and b=|Q|+Vdd/2, (a+b)/2 is equal to Vdd/2−(|Q|−|I|)/2, which means that 20 judges whether |Q|−|I| is larger than 0 V.

When the output |I| from 13 is smaller than or equal to the output |Q| from the first output terminal of 14, that is, when |Q|≧|I|, the relationship |Q|−|1|≧0 is feasible, from which it follows that (a+b)/2 is higher than the threshold voltage Vth (=Vdd/2), output c from 20 is high and inverted c is low.

As a high level control signal is input to the first multiplexer 21, the second output 16 of 14 is selected, and so the output from 21 is Vdd/2−|Q, which is the output of 16. As a low level control signal is input to the second multiplexer circuit 22, the output of 13 is selected, and the output of 22 is Vdd/2−I|, which is the output of 13. The outputs of the first and second multiplexer circuits 21 and 22 are input to inverting amplifier 25 through input capacitors 23 and 24, respectively. Assuming that the ratio of capacity of feedback capacitor 26, first input capacitor 23 and second input capacitor 24 is 11:10:5, the output shown in formula (6) is obtained from output terminal 27:

$$Mag = \frac{10}{11}\mathrm{Abs}(Q) + \frac{5}{11}\mathrm{Abs}(I) + \frac{Vdd}{2} \tag{6}$$

When |Q|<|I|, contrary to the above, (a+b)/2 is lower than Vth (=Vdd/2); therefore, c is low and inverted c is high.

The output of 21 is Vdd/2−|I|, which is the output of 13, and the output of 22 is Vdd/2−|Q|, which is the output of 16 of 14. Therefore, from formula (4), the output obtained from output terminal 27 is calculated by formula (7):

$$Mag = \frac{10}{11}\mathrm{Abs}(1) + \frac{5}{11}\mathrm{Abs}(Q) + \frac{Vdd}{2} \tag{7}$$

From the circuit in FIG. 1, the outputs calculated by formulas (6) and (7) can be obtained when Abs(Q)>Abs(I) and when Abs(Q)<Abs(I), respectively. That is, the output from this circuit is calculated by formula (8):

$$Mag = \frac{10}{11}\mathrm{Max}\{\mathrm{Abs}(1), \mathrm{Abs}(Q)\} + \frac{5}{11}\mathrm{Min}\{\mathrm{Abs}(I), \mathrm{Abs}(Q)\} \tag{8}$$

Formula (8) is mathematically equivalent to formula (5), and has the same accuracy of approximation in it. Hereinafter, the equivalence of formulas (8) and (5) is described. To simplify, formulas (5) and (8)

$$y = \frac{15}{22}(|I| + |Q|) + \frac{5}{22}||I| - Q||$$

are changed into (5)' and (8)':

$$y = \frac{10}{11}(\mathrm{Max}(|I|, |Q|)) + \frac{5}{11}(\mathrm{Min}(|I|, |Q|)) \quad (8)'$$

In formula (8)', two cases, |I|≧|Q| and |I|<|Q|, are considered and described. When |I|≧|Q| formula (8)' can be expressed in formula (9) and when |I<|Q|, it can be expressed in formula (10):

$$y = \frac{10}{11}|I| + \frac{5}{11}|Q| \quad (9)$$

$$y = \frac{10}{11}|Q| + \frac{5}{11}|I| \quad (10)$$

Formula (11) is obtained by adding formulas (9) and (10) and dividing by 2:

$$y' + \frac{15}{22}(|I| + |Q|) \quad (11)$$

Formulas (12) and (13) are obtained by subtracting formula (11) from formulas (9) and (10), respectively:

$$e_1 = \frac{5}{22}(|I| - |Q|) \quad (12)$$

$$e_2 = \frac{5}{22}(|Q| - |I|) \quad (13)$$

Therefore, when |I|≧|Q|, formula (9) can be expressed by adding formulas (11) and (12), as in formula (14):

$$y = \frac{15}{22}(|I| + |Q|) + \frac{5}{22}(|I| - |Q|) \quad (14)$$

When |I|<Q|, formula (10) can be expressed by adding formulas (11) and (13), as in formula (15):

$$y = \frac{15}{22}(|I| + |Q|) + \frac{5}{22}(|Q| - |I|) \quad (15)$$

Integrating (12) and (13), formula (16) is obtained:

$$y = \frac{15}{22}(|I| + |Q|) + \frac{5}{22}||I| - |Q|| \quad (16)$$

That is, formula (9) is the same as formula (5).

Figure 14A:
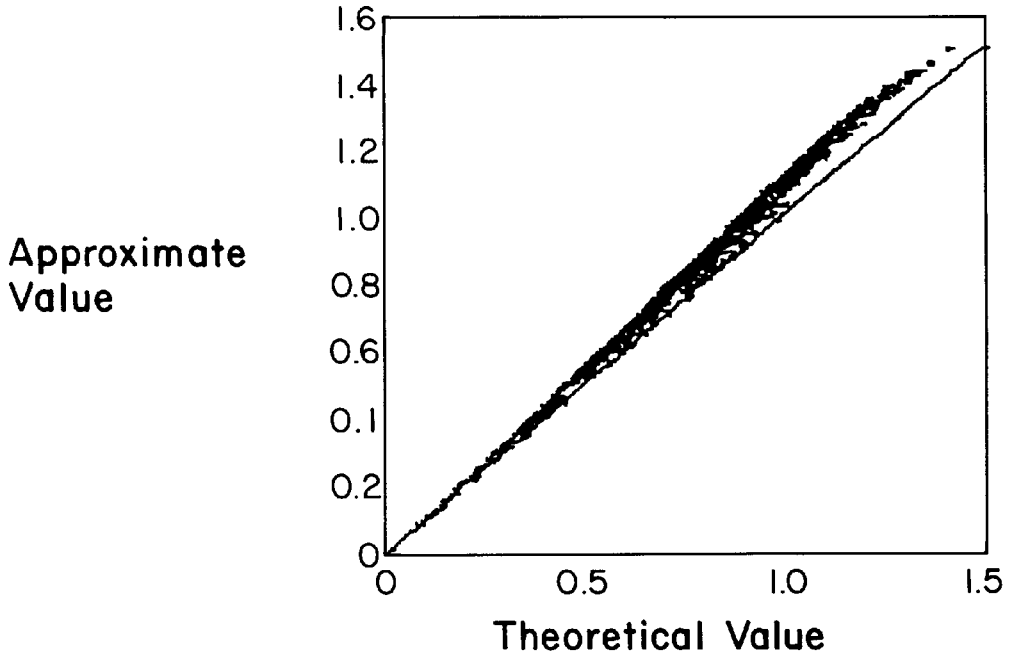
FIGS. 14(*a*) and 14(*b*) show the simulation results by the vector absolute-value calculation circuit according to the present invention.
Figure 14B:
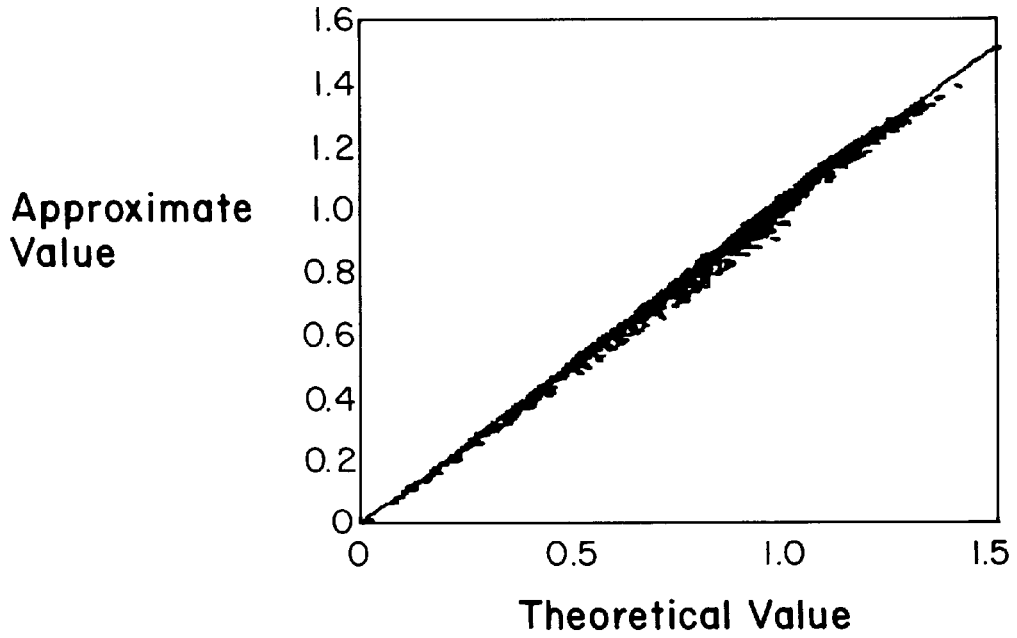
Figure 15A:
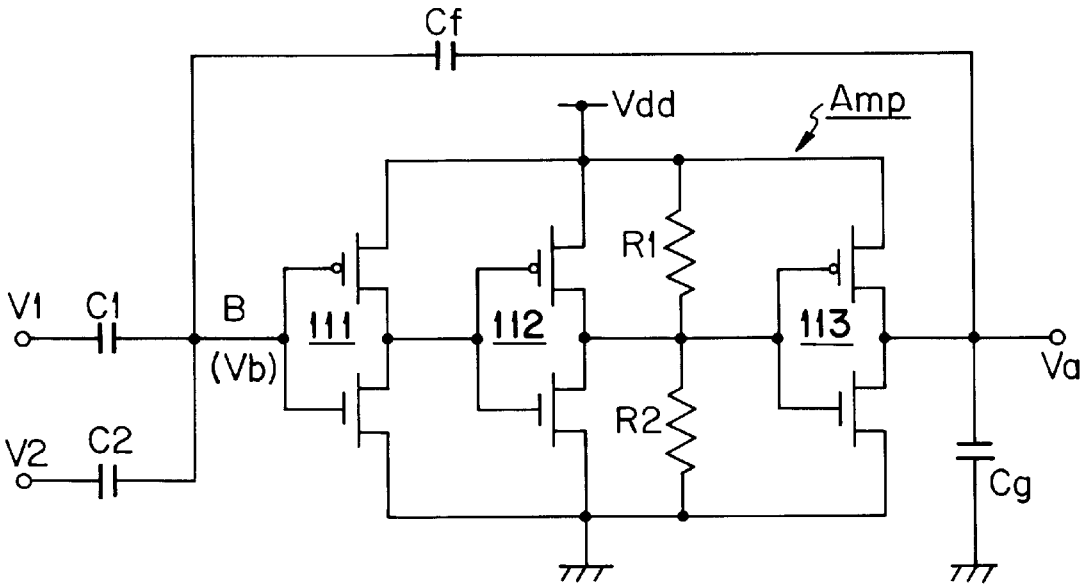
FIG. 15(a) (BACKGROUND ART)
FIGS. 15(*a*) and 15(*b*) show the neural computation circuits.
Figure 15B:
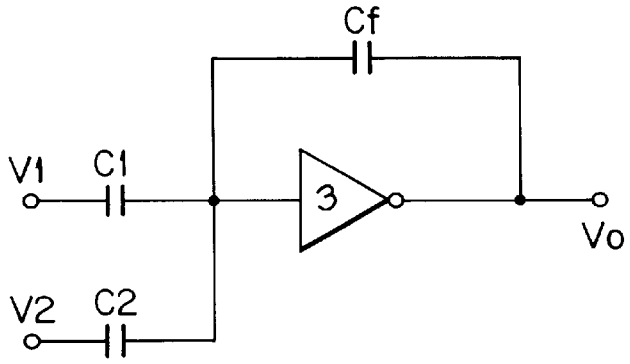
FIG. 15(b) (BACKGROUND ART)

FIGS. 14(*a*) and 14(*b*) show the simulated outputs of such an absolute-value calculation circuit: these correspond to some 1000 various inputs. In FIGS. 14(*a*) and 14(*b*), horizontal axes show the theoretical output values and vertical axes show the simulated data. The relationships between the theoretical and approximate values of simulation are plotted. The diagonal lines in the figures show the identification of the theoretical and approximate values of simulation. As the plotted points are close to these lines, the approximations show high accuracy. FIG. 14(*a*) shows the simulated result using the approximation in formula (2), and FIG. 14(*b*) shows that using the approximation in formula (5). FIG. 14(*a*) shows good results obtained by formula (2), but FIG. 14(*b*) shows better results obtained by formula (5).

Although the capacity ratio of feedback capacitor 26, first input capacitor 23 and second input capacitor 24 is 11:10:5 in the above embodiment, there is no restriction to this ratio. For example, the ratio 8:8:3 also provides very good results, using the approximation in formula (17):

$$Mag = Max\{Abs(I), Abs(Q)\} + \tfrac{3}{8}Min\{Abs(I), Abs(Q)\} \quad (17)$$

Figure 7:
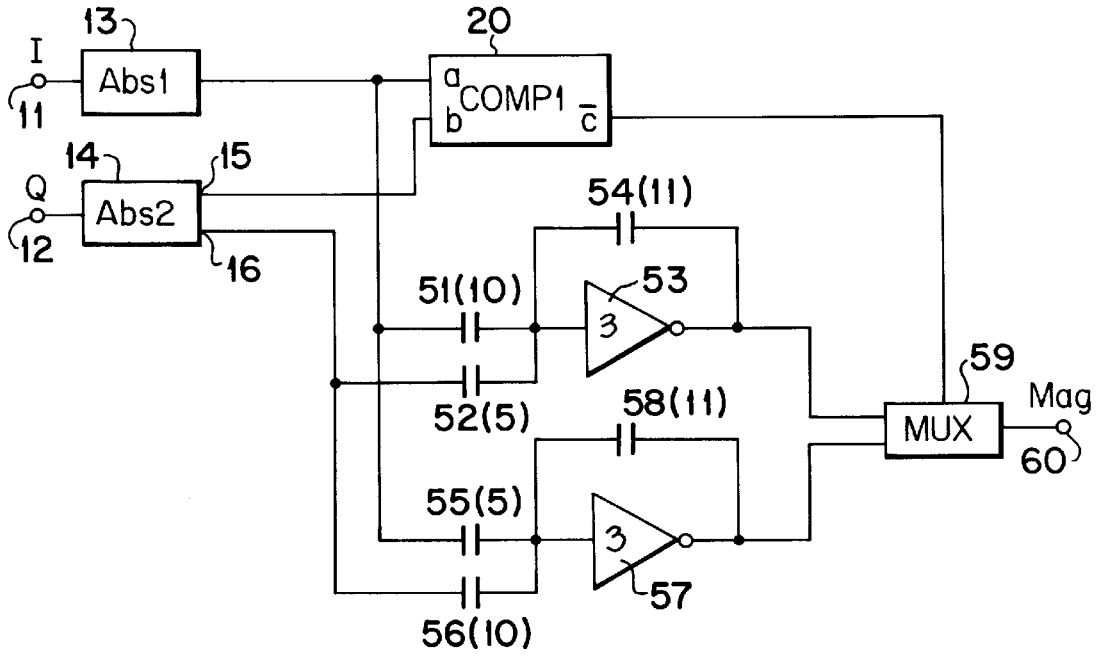
FIG. 7 shows the structure of the second embodiment of the vector absolute-value calculation circuit according to the present invention.

FIG. 7 shows the second embodiment of the absolute-value calculation circuit according to the present invention. This circuit has a structure similar to that in FIG. 1, but differs from it by incorporating two neural computation and one multiplexer circuits.

In this figure, the portions identical with those ire FIG. 1 are similarly designated and their description is omitted. Part 53 is the inverting amplifier, 51 and 52 are input capacitors of 53, and 54 is a feedback capacitor of 53: they form the first neural addition circuit. The ratio of capacitors 51, 52 and 54 is 10:5:11. Part 57 is the inverting amplifier, 55 and 56 are input capacitors of 57, and 58 is a feedback capacitor of 57: they form the second neural addition circuit. The ratio of capacitors 55, 56 and 58 is 5:10:11. Input capacitors 51 and 55 are connected to the output of the first absolute-value calculation circuit 13, and 52 and 56 are connected to the second output terminal 16 of the second absolute-value calculation circuit 14. Part 59 is a multiplexer circuit, in which the outputs of 53 and 57 are input signals, and to which the inverted output of the first comparator circuit 20 (inverted c) is input as a control signal.

In a vector absolute-value calculation circuit with the above structure, inverted absolute-values Vdd/2−|I| of component I input signals are output from 13, component Q input signal absolute-values Vdd/2+|Q| are output from 15, and inverted absolute-values Vdd/2−|Q| of component Q input signals are output from 16. As in FIG. 1, 20 works as a comparator, in which the inverted output (inverted c) is low when the absolute-value of component Q input signal |Q| is larger than or equal to that of component I input signal |I (|Q|≧|I),and it is high when |Q|<|I|.

(10/1 1)|I|+(5/11)|Q|+offset voltage is output from 53, and (5/11)|I|+(10/11)|Q|+offset voltage is output from 54. When a high level control signal is input to 59 from inverted c of 20 with the condition |I|≧|Q|, the output of 53 is selected and (10/11)|I|+(5/11)|Q| is output from output terminal 60 as vector absolute-value signal Mag. When the condition is Q|>|I|, a low level control signal is input to 59 from inverted c of 20, and (5/11)|I|+(10/11)Q|, which is the output of 54, is output from output terminal 60.

Figure 16:
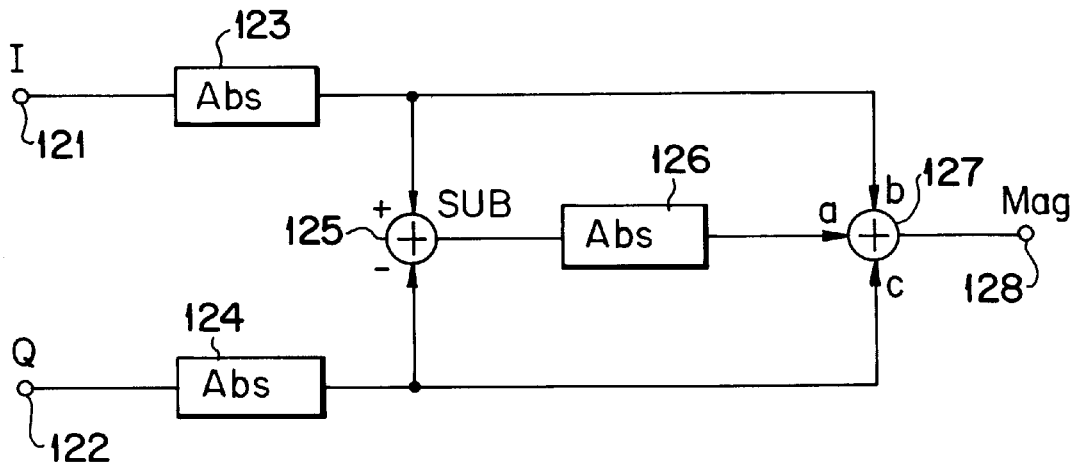
FIG. 16 (BACKGROUND ART)
FIG. 16 shows an exemplary structure of a conventional vector absolute-value calculation circuit.
Figure 17:
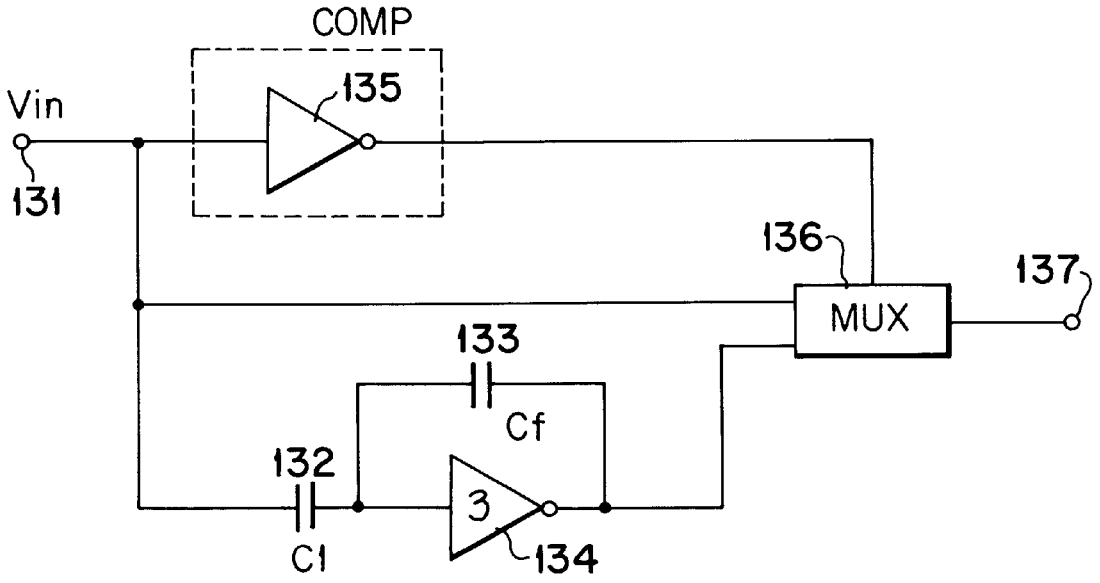
FIG. 17 (BACKGROUND ART)
FIG. 17 shows the structure of an absolute value calculation circuit in a conventional vector absolute-value calculation circuit.

Formula (8) thus calculates the approximate value in a way similar to that of the embodiment in FIG. 1. In this embodiment, there are four neural computation circuits, signifying a reduction of two such circuits from the conventional embodiment in FIG. 16.

Figure 8:
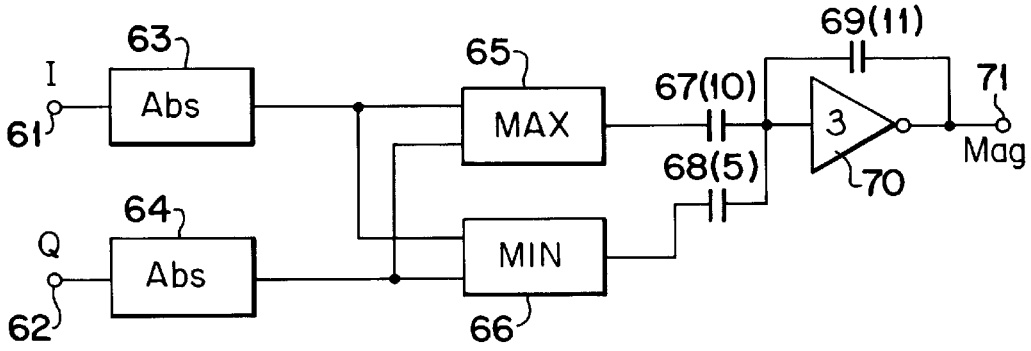
FIG. 8 shows the structure of the third embodiment of the vector absolute-value calculation circuit according to the present invention.

Hereinafter, a third embodiment for calculating vector absolute-values according to formula (8) is described, with FIG. 8 showing a block diagram of this embodiment. In FIG. 8, 61 is a component 1 input terminal, 62 is a component Q input terminal, 63 is an absolute-value calculation circuit for outputting |I|. which is the absolute-value of component I input from 61, and 64 is an absolute-value calculation circuit for outputting |Q|, which is the absolute-value of component Q input from 62. Part 65 is the maximum-value-selecting circuit MAX for receiving |I| from 63 and |Q| from 64, then comparing them and outputting the larger value, and 66 is minimum-value-selecting circuit MIN for receiving |I| from 63 and |Q| from 64, then comparing them and outputting the smaller value. Part 70 is an inverting amplifier having the same function as that of the above embodiment, 67 and 68 are input capacitors of 70, 69 is a feedback capacitor, and 71 is an output terminal connected to the output of 70. The ratio of 67, 68 and 69 is 10:5:11. The output of MAX65 is input to 67, and the output of MIN66 is input to 68.

In the vector absolute-value calculation circuit with this structure, |I| is output from 63 and |Q| is output from 64. Both of the signals |I| and |Q: are input to both 65 and 66, so that Max(|I|, |Q|) is output from 65 and Min(|I|,|Q|) is output from 66. Outputs of 65 and 66 are weighted corresponding to the ratio of the capacitors and added in a neural computation circuit including 70, and the output value calculated by formula (8) is output at 71. This enables formula (8) to calculate the approximations.

Figure 9A:
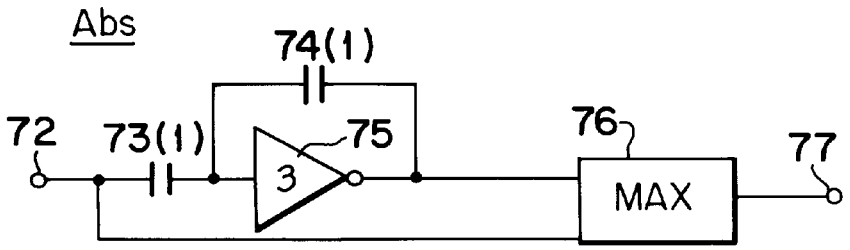
FIGS. 9(*a*)–9(*c*) show the structure of the absolute-value calculation circuit, the maximum value calculation circuit and the minimum value calculation circuit of the third embodiment.
Figure 9B:
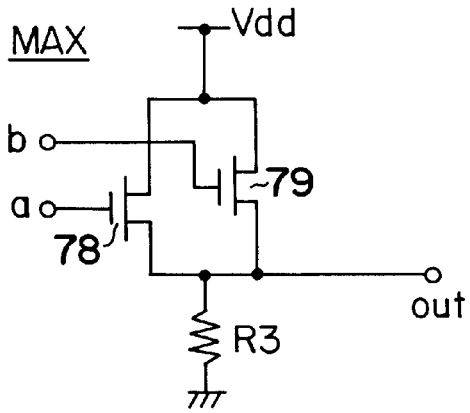
Figure 9C:
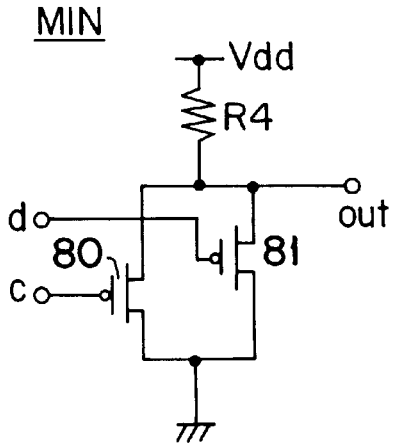

FIG. 9(*a*) shows the structure of 63 and 64. In FIG. 9(*a*), 72 is an input terminal for receiving analog signal voltage, 77 is an output terminal, 75 is an inverting amplifier similar to that above, 73 is an input capacitor connected between input terminal 72 and inverting amplifier 75, and 74 is the feedback capacitor of 75. The ratio of 73 and 74 is 1. Part 76 is the maximum-value-selecting circuit for receiving output signals from 75 and input signals from 72, and then outputting the signal with higher voltage at output terminal 77.

The signal with the inverted polarity of the input signal of 72 is output from 75 in Abs with such a structure. Therefore, the input signal and the inverted-polarity signal are input, and the signal with higher voltage is selected and output. When the input signal is positive, a negative signal is output from 75 and input signal above with positive polarity from 76. Conversely, when the input signal is negative, a positive signal having the same magnitude as the input signal is output from 75, and a positive signal from 75 is selected and output from 76. That is, the absolute-value of the input signal is output from 77.

FIG. 9(*b*) shows the structure of MAX65 and 76. In FIG. 9(*b*), 78 and 79 are nMOSFETs in which the first input a is connected to the gate of nMOSFET78, and the second input b is connected to the gate of nMOSFET79. The drains of nMOSFETs 78 and 79 are connected to supply voltage Vdd, and their sources are commonly connected and grounded through high-resistance R3. The point connecting the sources of both FETs and resistance R3 is connected to output terminal out. This structure constitutes a source-follower circuit.

In maximum-value-calculation circuit MAX with this structure, as the MOSFET gate voltage is generated at the source, the higher voltage among a and b is generated at the source commonly connected to FET78 and FET79. In the FET receiving the lower input voltage at its gate, the voltage between its gate and source is reversely biased and the FET is cutoff, and so only the FET receiving the higher voltage is conductive. The source potential of the FET with higher voltage becomes its input voltage, and then the higher input voltage is output from output terminal 'out'.

FIG. 9(*c*) shows an exemplary embodiment of the minimum-value-calculation circuit MIN66. In FIG. 9(*c*), 80 and 81 are pMOSFETs whose gates receive inputs c and d, respectively. Both drains of FETs 80 and 81 are grounded, and their sources are commonly-connected and further connected to supply voltage Vdd through high-resistance R4. The connection point of R4 and the commonly connected sources is connected to output terminal out.

In minimum-value-calculation circuit MIN with this structure, as the MOSFET gate voltage is generated at the source as it is, the voltage of c and d is generated at the sources of pMOSFETs 80 and 81. At the source to which 80 and 81 are commonly connected, the lower voltage among c and d is generated. The FET receiving the higher voltage at its gate is cutoff, because the voltage between the gate and source is reversely biased; consequently, the FET receiving the lower voltage at its gate is conducive, and the lower input voltage is output from 'out'.

When an analog calculation circuit like a neural calculation circuit is used, the residual charge generates an offset voltage, which lowers the accuracy of calculations. To solve this problem, for example, two sets of vector absolute-value calculation circuits shown in FIG. 1 or 7 are used so as to refresh one circuit while the other is functioning. Doing so, however, doubles the circuit size. That is, the embodiment in FIG. 1 with three neural operational amplifiers requires six such amplifiers, and the embodiment in FIG. 7 with four neural operational amplifiers requires eight. Signals for controlling refreshment have to be provided from outside.

To solve this problem, the fourth embodiment is described with reference to FIG. 10. This embodiment is based on the vector absolute-value calculation circuit in FIG. 1, with modifications that enable refreshing. In this embodiment, the first absolute-value calculation circuit (Abs 1) 13 in FIGS. 1 and 2 is replaced by the first absolute-value calculation circuit (Abs1r) 83 in FIG. 11, and the second absolute-value calculation circuit (Abs2) 14 in FIGS. 1 and 3 is replaced by the second absolute-value calculation circuit (Abs2r) 84 in FIG. 12, both 83 and 84 refreshment-capable. The neural operational amplifier structured by inverting amplifier 25 in FIG. 1 is replaced by a parallel pair of such amplifiers, also capable of refreshment.

Figure 10:
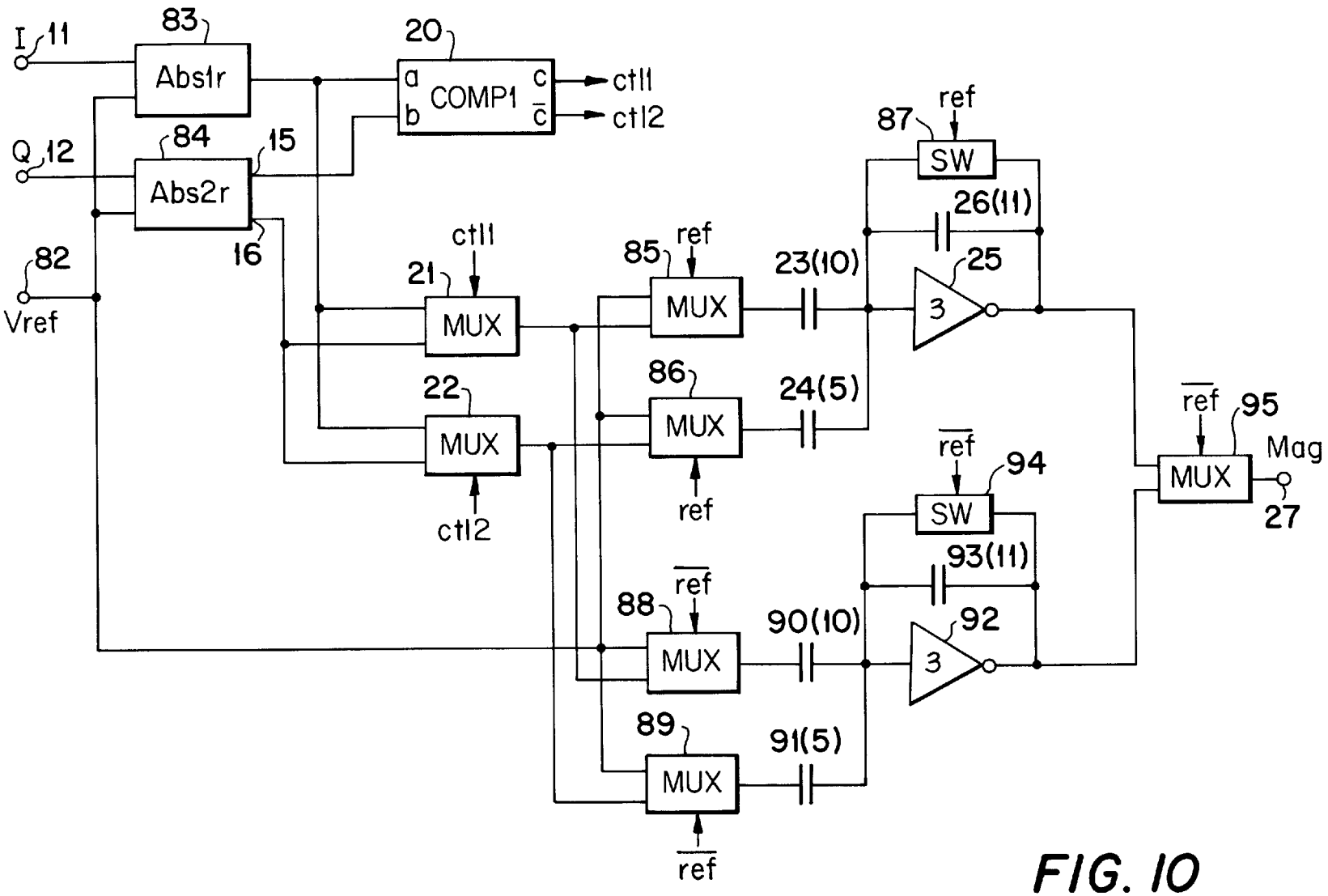
FIG. 10 shows the structure of the fourth embodiment of the vector absolute-value calculation circuit of the fourth embodiment.

In FIG. 10, the components identical with those in FIG. 1 are similarly designated and their description omitted. Part 82 is the reference voltage input terminal receiving reference voltage Vref (=Vdd/2), 83 is the first absolute-value calculation circuit (Abs1r) with refreshment capability, and 84 is the second absolute-value calculation circuit (Abs2r) with refreshment capability. The details of 83 and 84 are provided later.

Parts 85 and 86 are multiplexer circuits connected to input capacitors 23 and 24, respectively, receiving outputs of multiplexer circuits 21 and 21, respectively, at their first inputs, and receiving reference potential Vref from 82 at their second inputs. Refresh control signal 'ref' is also input to them. Feedback capacitor 26 of inverting amplifier 25 is connected in parallel to switching circuit 87, to which ref is input. When 'ref' is a high level, 85 and 86 select Vref, and 87 is conductive and shortcuts 26. Consequently, the input of 25 is reset by Vref, resulting in the residual charge being canceled. The neural operational amplifier including 25 is enabled to refresh itself.

Parts 88 and 89 are the same multiplexers as 85 and 86. They receive the outputs of multiplexer circuits 21 and 22, respectively, at their first inputs, and receive reference potential Vref from 82 at their second inputs. Part 92 is an inverting amplifier, 90 and 91 are the first and second input capacitors connected to 88 and 89, respectively, 93 is a feedback capacitor connected between the input and output of 92, and 94 is a switching circuit set parallel to 93. A reversed refresh control signal (reversed 'ref') is input to 88, 89 and 94 as a control signal.

Part 95 is a multiplexer circuit receiving a reversed 'ref' as a control signal, and the outputs of 25 and 92. This multiplexer circuit 95 selects the output of the inverting amplifier not being refreshed and outputs it to output terminal 27.

In this embodiment, as mentioned above, double neural operational amplifiers with the same structure are provided. While one of them is being refreshed, the other one performs operations. For example, when 'ref' is high and the neural operational amplifier including 25 is being refreshed, 88 and 89 select 21 and 22: that is, the operations performed in the neural operational amplifier including 25 are performed in the other neural operational amplifier including 90, 91, 92 and 93, instead.

Figure 11:
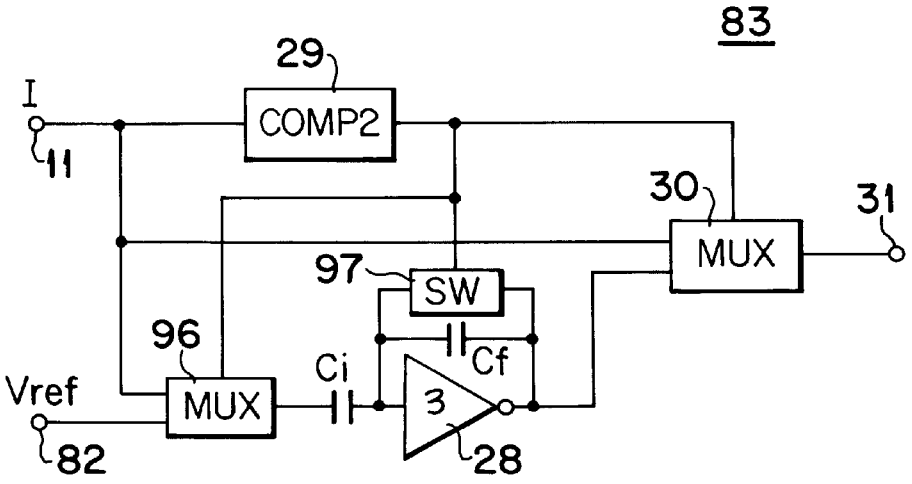
FIG. 11 shows the structure of the first absolute-value calculation circuit with refreshment capability.

FIG. 11 shows the structure of refreshment-capable circuit 83 in FIG. 10. In FIG. 11, the components identical with those in FIG. 2 are similarly designated and their description omitted. Part 82 is the reference voltage input terminal receiving Vref (=Vdd/2), which is the reference voltage to be input to a neural computation circuit undergoing refreshment, 96 is a multiplexer circuit for selecting either component I input signal input frown component I input terminal 11 or reference potential Vref input from 82 to connect them to input capacitor Ci, and 97 is a switching circuit connected in parallel to feedback capacitor Cf. The output of the second comparator 29 is input to 96 and 97 as a control signal.

In the first refreshment-capable absolute-value calculation circuit 83, as explained with respect to FIG. 2, when the level of component I signal input from component I input terminal 11 is lower than the reference potential (Vdd/2), a high level signal is output from the second comparator 29, and multiplexer circuit 30 selects component I input terminal 11 to connect it to output terminal 31. Here, this neural computation circuit is refreshed during the processing, since as the output of neural computation circuit including inverting amplifier 28 is not used. Therefore, the refreshment is performed during high level outputs from comparator 29, and it ensues that 96 selects 82, and 97 is closed to cancel the residual charge in Ci and Cf. This shows that 83 needs no refresh signal 'ref' from outside; that is, it can control refreshment by inside status signals (outputs of 29).

Figure 12:
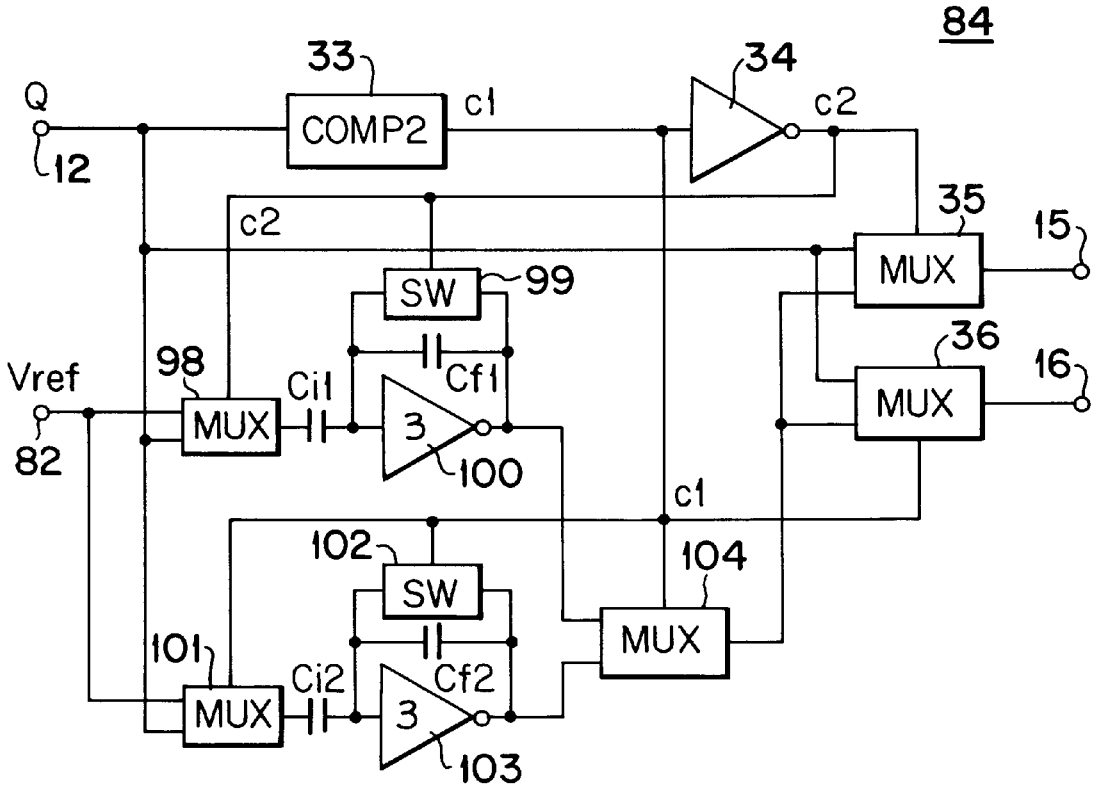
FIG. 12 shows the structure of the second absolute-value calculation circuit with refreshment capability.

FIG. 12 shows the structure of the second refreshment capable absolute-value calculation circuit (Abs2r) 84. In FIG. 12, the components identical with those in FIG. 3 are similarly designated and their description omitted. Part 82 is the same reference voltage input terminal as above, 98 and 101 are multiplexer circuits both of which select either component Q input signal from component Q signal input terminal 12 or the reference voltage from reference voltage input terminal 82 according to control signals. The outputs of inverter circuit 34 (c2) are input to the third multiplexer circuit 98 as a control signal, and outputs of the second comparator 33 (c1) are input to the fourth multiplexer circuit 101 as a control signal.

Part 100 is an inverting amplifier structuring the first neural computation circuit, to which output of the third multiplexer circuit 98 is connected through input capacitor Cil, and to whose feedback capacitor Cf1 switching circuit 99 is connected in parallel to Cf1. Part 103 is an inverting amplifier structuring the second neural computation circuit, to which output of the fourth multiplexer circuit 101 is connected through input capacitor Ci2, and whose feedback capacitor Cf2 switching circuit 102 is connected in parallel to Cf2. The outputs of 100 and 103 are input to the fifth multiplexer circuit 104, and its output is connected to the first and second multiplexer circuits 35 and 36 at their second inputs.

The outputs of 34 (c2) are input as control signals to 98 and 99, and the outputs of 33 (c1) are input as control signals to 101, 104 and 102.

This circuit differs from 14 in FIG. 3 in that it incorporates two neural computation circuits in parallel.

In this circuit, when component Q input signal voltage VQ that is input from component Q signal input terminal 12 is equal to or lower than Vref (=Vdd/2), output voltage c1 generated in 33 is high, and output voltage c2 generated in 34 is low. Therefore, control signal c2 directs 98 to select component Q input signal from 12 to be input to Cil, and so 99 is opened. The first neural computation circuit including 100 is in the normal function mode, and outputs Vdd/2−Q, as described with respect to FIG. 3.

On the other hand, c1 directs 101 to select Vref from 82 to be input to Ci2, and so 102 is conductive. Therefore, this second neural computation circuit is refreshed so as to cancel the residual charge stored in both capacitors Ci2 and Cf2.

Also, c1 directs 104 to select the output of 100 in the normal function mode. The output of 104 is sent to the first output terminal 15 through 35, and component Q input signal from 12 is output from the second output terminal 16 through 36.

When VQ input from 12 is higher than Vref, conversely, the first neural computation circuit is in the refreshing mode and the second neural computation circuit is in the normal function mode. The fifth multiplexer circuit 104 is directed to select the output of 103, component Q signal from 12 is output from 15 through 35, and the output signal Vdd/2−Q from 104 is output from 16.

In this way, in the second absolute-value calculation circuit (Abs2r) with refreshment capability, refreshment is performed according to the inner status signals.

In this embodiment, as mentioned above, refreshment is performed on each neural computation circuit without lowering the processing speed. With only five neural computation circuits, it is possible to realize refreshment-capable circuits using minimal hardware.

Although the refreshment of the first and second absolute-value calculation circuits is performed by inner status signals in the above embodiment, it is not limited to this method: the refreshment can be performed using a refreshment control signal ref with predetermined timing from outside.

In the fourth embodiment above, ref must be input from outside the absolute-value calculation circuit so as to refresh inverting amplifiers 25 and 92; moreover, multiplexer circuits must be provided for switching inputting and outputting to and from the doubled neural computation circuits. Hereinafter, another embodiment without this requirement is described.

Figure 13:
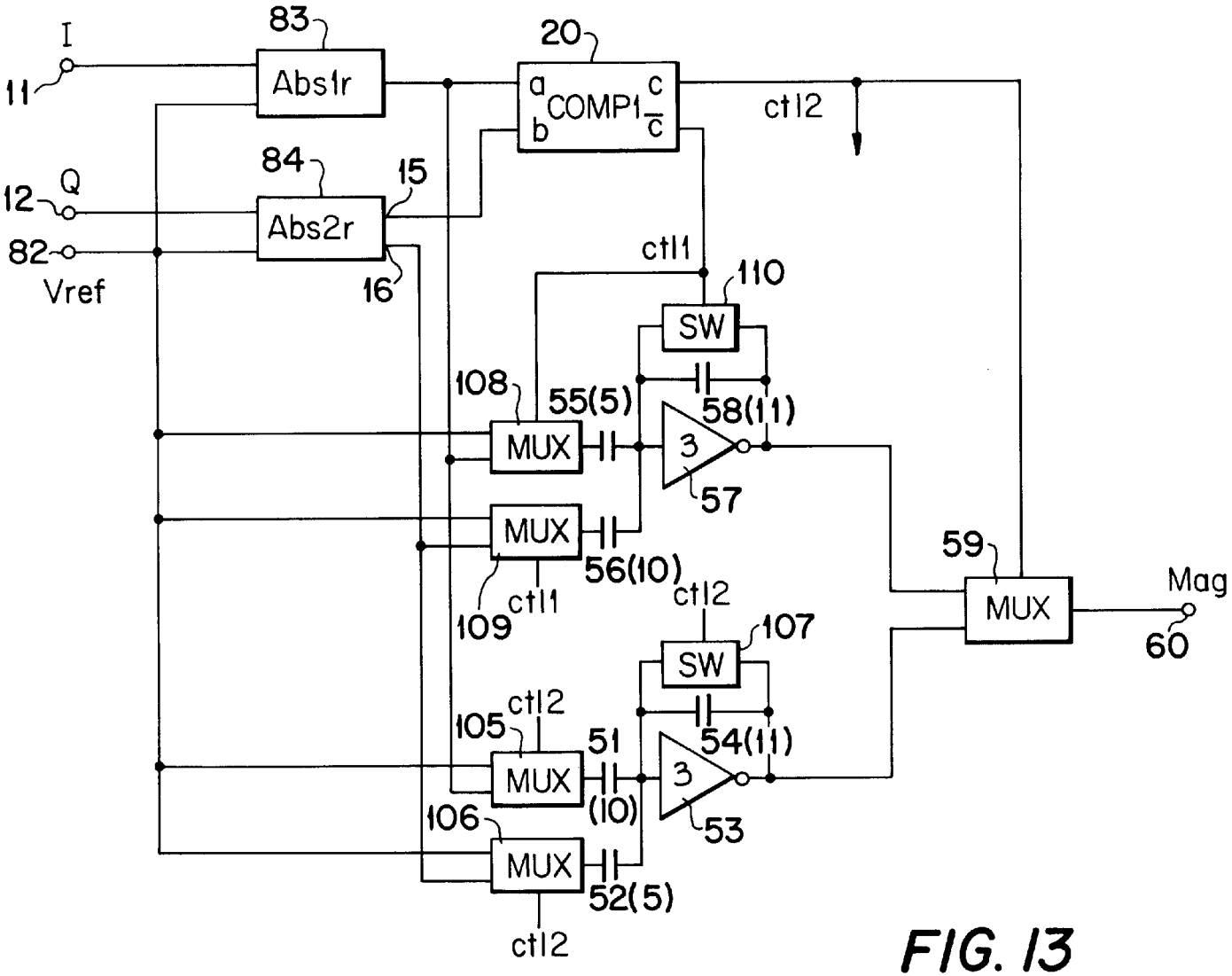
FIG. 13 shows the structure of the fifth embodiment of the vector absolute-value calculation circuit according to the present invention.

FIG. 13 shows the fifth embodiment, which is based on that in FIG. 7 but restructured to make it refreshment-capable. In FIG. 13, the components identical with those in FIG. 7 are similarly designated and their description omitted. In this figure, 83 is the first absolute-value calculation circuit (Abs1r) shown in FIG. 11, and 84 is the second absolute-value calculation circuit (Abs2r) shown in FIG. 12, both circuits being refreshment-capable. Part 82 is the reference voltage input terminal for inputting reference voltage Vref. Part 53 is the first inverting amplifier structuring the first neural computation circuit. To 51 and 52, which are the first and second input capacitors of 53, the first multiplexer circuit 105 and the second multiplexer circuit 106 are connected, respectively, so that Vref and outputs of the first and second absolute-value calculation circuits 83 and 84 are selectively input to the first neural computation circuit.

Part 57 is the second inverting amplifier structuring the second neural computation circuit. Similar to the above configuration, the first and second input capacitors 55 and 56 of 57 are connected to the third and the fourth multiplexer circuits 108 and 109, respectively, so that Vref and outputs of the first and second absolute-value calculation circuits 83 and 84 are selectively input to the second neural computation circuit. Switching circuit 107 is connected in parallel to feedback capacitor 54, which is connected between output and input of the first inverting amplifier 53, and switching circuit 110 is connected in parallel to feedback capacitor 58, which is connected between output and input of the second inverting amplifier 57.

Output c of the first comparator 20 is input to 105, 106 and 107 as control signal ctl2, and the inverted output of 20 (inverted c) is input to 108, 109 and 110 as control signal ctl1.

In a vector absolute-value calculation circuit with such a structure, similar to the embodiment in FIG. 7, when component I absolute-value |I| input from component I input terminal 11 is equal to or larger than Q-component absolute-value |Q| input from component Q input terminal 12, the inverted output (inverted c) of the first comparator 20 is high and output c is low. Consequently, the third and fourth multiplexer circuits 108 and 109 receive high level control signal ctl1, select the reference voltage input from 82 and send it to 55 and 56. Switching circuit 110 is conductive, and it ensues that the second neural computation circuit is refreshed.

The first multiplexer circuit 105 selects the output of 83, the second multiplexer circuit 106 selects the second output 16 of 84, and switching circuit 107 is cutoff. Therefore, the first neural computation circuit is in the normal function mode, and the signal voltage corresponding to the operation result of formula (9) is output from 53. As the control signal ctl2 input to the fifth multiplexer circuit 59 is low, the output signal from 53 is selected and output from output terminal 60.

On the other hand, when |I| from 11 is smaller than |Q| from 12, output c is low and inverted c is high. Thus, contrary to the above configuration, the second neural computation circuit is in the normal function mode and the first neural computation circuit is refreshed. The absolute-value signal calculated in the second neural computation circuit is selected by 59 and output from 60.

According to the embodiment in FIG. 13, a refreshment-capable absolute-value calculation circuit can be structured using only five neural computation circuits. The refreshment can be controlled by the inner status signals, without requiring any outside 'ref'.

Although the two quadrature signals are component I and component Q of the QPSK method in the above embodiment, there is no restriction so long as two-dimensional vectors are calculated.

As mentioned above, the vector absolute-value calculation circuit according to the present invention uses minimal hardware and is capable of very rapid and highly accurate calculations.

Also, refreshment is performed with minor increase in hardware quantity and without receiving any control signal from outside of the circuit.

What is claimed is:

1. A vector absolute-value calculation circuit comprising:

i) a first absolute-value calculation circuit, to which a first input signal is input corresponding to a first component of a two-dimensional vector, for outputting a first absolute-value calculated signal having an amplitude equal to an amplitude of said first input signal, and having a single polarity;

ii) a second absolute-value calculation circuit, to which a second input signal is input corresponding to a second component of a two-dimensional vector, for outputting a second absolute-value calculated signal having an amplitude equal to an amplitude of said second input signal, and having a single polarity; and iii) operating means for multiplying a first coefficient with a larger of said first and second absolute-value signals, for multiplying a second coefficient with a smaller of said first and second absolute-value signals, and for outputting a signal comprising a sum of both multiplication results.

2. A vector absolute-value calculation circuit as claimed in claim 1, wherein said first coefficient is 10/11 and said second coefficient is 5/11.

3. A vector absolute-value calculation circuit as claimed in claim 1, said first absolute-value calculation circuit comprising:

i) an input terminal for receiving said first input signal;

ii) a polarity-inverting circuit for outputting a signal comprising said first input signal with inverted polarity; and iii) a selecting circuit for selecting and outputting a signal among said first input signal and the output signal of said polarity-inverting circuit, according to said polarity of said first input signal.

4. A vector absolute-value calculation circuit as claimed in claim 3, said polarity-inverting circuit comprising an input capacitor comprising one terminal connected to said input terminal and another terminal connected to an input terminal of an inverting amplifier having a feedback capacitor between its input and output, a ratio of the capacitance of said input capacitor to the capacitance of said feedback capacitor being 1.

5. A vector absolute-value calculation circuit as claimed in claim 3, said polarity-inverting circuit comprising:

i) a multiplexer circuit comprising one input connected to said input terminal and another input connected to a reference potential, for outputting according to an input control signal either a signal input from said input terminal or said reference potential;

ii) an inverting amplifier;

iii) an input capacitor comprising one terminal connected to an output of said multiplexer circuit and another terminal connected to an input terminal of an inverting amplifier;

iv) a feedback capacitor connected between an input and an output of said inverting amplifier and having the same capacity as that of said input capacitor; and v) a switching circuit connected in parallel to said feedback capacitor, said switching circuit opening and closing in accordance with said control signal;

wherein said control signal comprises a signal output by said first absolute-value calculation circuit.

6. A vector absolute-value calculation circuit as claimed in claim 1, said second absolute-value calculation circuit comprising:

i) an input terminal for receiving said second input signal;

ii) first and second output terminals;

iii) a polarity-inverting circuit for outputting a signal comprising said second input signal with inverted polarity; and iv) a selecting circuit for outputting the output signal of said polarity-inverting circuit and said second input signal to said first and second output terminals, respectively, when said second input signal is a first polarity, and for outputting said second input signal and said output signal of said polarity-inverting circuit to said first and second output terminals, respectively, when said second input signal is a second polarity.

7. A vector absolute-value calculation circuit as claimed in claim 1, said second absolute-value calculation circuit comprising:

i) first and second polarity-inverting circuits each comprising:

a) an input terminal for receiving said second input signal;

b) first and second output terminal;

c) a multiplexer circuit comprising one input connected to said input terminal and another input connected to a reference potential, said multiplexer circuit outputting according to an input control signal either a signal input from said input terminal or said reference potential;

d) an inverting amplifier, having an input and an output;

e) an input capacitor comprising one terminal connected to an output of said multiplexer circuit and another terminal connected to an input terminal of an inverting amplifier;

f) a feedback capacitor connected between said input and said output and having the same capacity as said input capacitor; and g) a switching circuit connected in parallel to said feedback capacitor, said switching circuit opening and closing in accordance with said control signal; and ii) selecting means for outputting output signals of said first polarity-inverting circuit and said second input signals to said first output terminal and said second input terminal, respectively, when said second input signal is the first polarity, and for outputting said second input signals and outputs of said second polarity-inverting circuit to said first output terminal and said second output terminal, respectively, when said second input signal is the second polarity.

8. A vector absolute-value calculation circuit comprising:

i) a first input terminal receiving a first input signal corresponding to a first component of a two-dimensional vector;

ii) a second input terminal receiving a second input signal corresponding to a second component of a two-dimensional vector;

iii) a first absolute-value calculation circuit connected to said first input terminal, for outputting a first absolute-value signal having an amplitude equal to an amplitude of said first input signal, and having a single polarity;

iv) a second absolute-value calculation circuit connected to said second input terminal, for outputting a second absolute-value signal having an amplitude equal to an amplitude of said second input signal, having a single polarity;

v) a comparison circuit for comparing said first and second absolute-value signals;

vi) first selecting means for operating after comparison in said comparison circuit to select and output said first absolute-value signal when said first absolute-value signal is equal to or larger than said second absolute-value signal, and to select and output said second absolute-value signal when said first absolute-value signal is smaller than said second absolute-value signal;

vii) second selecting means operating after comparison in said comparison circuit to select and output said second absolute-value signal when said first absolute-value signal is equal to or larger than said second absolute-value signal, and to select and output said first absolute-value signal when it is smaller than said second absolute-value signal; and viii) a weighted addition circuit for multiplying said first coefficient with an input signal from said first selecting means, for multiplying said second coefficient with an input signal from said second selecting means, and for outputting a signal comprising a sum of both multiplication results.

9. A vector absolute-value calculation circuit as claimed in claim 8, wherein said weighted addition circuit comprises:

i) a first input terminal;

ii) a second input terminal;

iii) a first input capacitor, comprising one terminal connected to said first input terminal;

iv) a second input capacitor comprising one terminal connected to said second input terminal; and v) an inverting amplifier comprising an output and an input, said input being connected to another terminal of said first and second input capacitors, and a feedback capacitor connected between said input and said output of said inverting amplifier.

10. A vector absolute-value calculation circuit as claimed in claim 9, wherein said inverting amplifier comprises inverting circuits serially connected in an odd number of stages.

11. A vector absolute-value calculation circuit as claimed in claim 9, wherein said first coefficient is defined by a ratio of a capacitance of said feedback capacitor to a capacitance of said first input capacitor, and wherein said second coefficient is defined by a ratio of a capacitance of said feedback capacitor to a capacitance of said second input capacitor.

12. A vector absolute-value calculation circuit comprising:

i) a first input terminal receiving a first input signal corresponding to a first component of a two-dimensional vector;

ii) a second input terminal receiving a second input signal corresponding to a second component of a two-dimensional vector;

iii) a first absolute-value calculation circuit, connected to said first input terminal, for outputting a first absolute-value signal having an amplitude equal to an amplitude of said first input signal, and having a single polarity;

iv) a second absolute-value calculation circuit, connected to said second input terminal, for outputting a second absolute-value signal having an amplitude equal to an amplitude of said second input signal, and having a single polarity;

v) a first weighted addition circuit for multiplying a first coefficient with said first absolute-value signal, for multiplying a second coefficient with said second absolute-value signal, and for outputting a signal comprising a sum of both multiplication results, vi) a second weighted addition circuit for multiplying said second coefficient with said first absolute-value signal, for multiplying said first coefficient with said second absolute-value signal, and for outputting a signal comprising a sum of both multiplication results;

vii) a comparison circuit for comparing said first and second absolute-value signals; and viii) selecting means operable after the comparison in said comparison circuit to select and output the output of said first weighted addition circuit when said first absolute-value signal is equal to or larger than said second absolute-value signal, and to select and output the output of said second weighted addition circuit when said first absolute-value signal is smaller than said second absolute-value signal.

13. A vector absolute-value calculation circuit as claimed in claim 12, each said first and second weighted addition circuit comprising:

i) a first multiplexer for receiving and outputting one of said first absolute-value signal and a reference;

ii) a second multiplexer for receiving and outputting one of said second absolute value signal and said reference;

iii) an inverting amplifier and a feedback capacitor connected between an input and an output of said inverting amplifier;

iv) a first input capacitor comprising a terminal connected to an output of said first multiplexer and another terminal connected to the input of said inverting amplifier;

v) a second input capacitor comprising a terminal connected to an output of said second multiplexer and another terminal connected to the input of said inverting amplifier; and vi) a switching circuit connected in parallel with said feedback capacitor;

wherein said reference is input to a weighted addition circuit not selected by said selecting means so as to control closure of said switching circuit.

14. A vector absolute-value calculating circuit comprising:

a first absolute-value calculation circuit comprising an input terminal receiving a first input signal comprising a first component of a two-dimensional vector, said first absolute-value circuit outputting a first absolute-value signal having a constant amplitude equal to an amplitude of said first input signal and having a constant polarity;

a second-value circuit comprising an input terminal receiving a second input signal comprising a second component of said two-dimensional vector, said second absolute-value calculation circuit outputting a second absolute-value signal having a constant amplitude equal to an amplitude of said second input signal and having a constant polarity; and a comparator for comparing an amplitude of said first absolute-value signal with an amplitude of said second absolute-value signal;

an operating circuit operable in accordance with the amplitude of said first absolute-value signal in relation to the amplitude of said second absolute-value signal to multiply said first and second absolute-value signals with respective first and second coefficients, said first and second coefficients comprising constant values with different amplitudes, said operating circuit outputting a signal comprising a weighted sum of said first absolute-value signal and said second absolute-value signal.

15. The vector absolute-value calculation circuit according to claim 14, wherein said first component of a two-dimensional vector comprises an I component which corresponds to a real portion of a complex number, and wherein said second component of said two-dimensional vector comprises a Q component which corresponds to an imaginary part of said complex number;

said first component comprising a voltage level which always remains positive, and exceeding a predetermined threshold level when said first component has a positive polarity and being below said predetermined threshold level when said first component has a negative polarity.

* * * * *